US006506123B1

(12) United States Patent
Weidlich

(10) Patent No.: US 6,506,123 B1
(45) Date of Patent: Jan. 14, 2003

(54) GOLF PUTTING TARGET

(76) Inventor: Robert D. Weidlich, 30 Dawson Rd., Kendall Park, NJ (US) 08824

( * ) Notice: Subject to any disclaimer, the term of this patent is extended or adjusted under 35 U.S.C. 154(b) by 0 days.

(21) Appl. No.: 08/918,595

(22) Filed: Aug. 24, 1997

Related U.S. Application Data

(63) Continuation-in-part of application No. 08/565,966, filed on Dec. 1, 1995, now abandoned.

(51) Int. Cl.[7] ..... A63B 69/36
(52) U.S. Cl. ..... 473/180; 473/409
(58) Field of Search ..... 473/169, 170, 473/172, 195, 196, 197, 185, 180, 168, 909

(56) References Cited

U.S. PATENT DOCUMENTS 1,656,740 A * 1/1928 Kurtz ..... 273/127 B
3,019,023 A * 1/1962 Westling ..... 473/180
3,086,779 A * 4/1963 Taylor ..... 473/180
4,934,704 A * 6/1990 Mazer ..... 473/158
5,435,560 A * 7/1995 Kehoe ..... 473/174
5,692,963 A * 12/1997 Holcombe ..... 473/158
5,971,863 A * 10/1999 Durso ..... 473/159
D435,618 S * 12/2000 Polk et al. ..... D21/790

* cited by examiner

*Primary Examiner*—Mark S. Graham
(74) *Attorney, Agent, or Firm*—Walter J. Tencza, Jr.

(57) ABSTRACT

A putting training system for practicing putting outdoors on a putting green or indoors on a carpeted surface comprising of a circular toroid putting target which by design has the ability to distinguish between a correctly or incorrectly struck putt with the rule that all putts should be struck hard enough force to leave the golf ball approximately seventeen inches past the hole if the hole was not there. The training aid target is a visually realistic, 360 degree, three dimensional depiction of a real hole on a putting green. This is accomplished by distinguishing the color of the outer half of the target from the inner half of the target. By coloring the outer half of the training aid target green and the inner half of the target black, one sees relatively the same view as a real hole when viewed from a distance.

1 Claim, 2 Drawing Sheets

GOLF PUTTING TARGET

CLAIM FOR PRIORITY

This application is a continuation in part of parent application Ser. No. 08/565,966 ("the parent") which was filed on Dec. 1, 1995 abandoned, and this continuation in part application claims the priority filing date benefit of the parent.

BACKGROUND—FIELD OF INVENTION

This invention relates to the game of golf, specifically to a putting training aid designed to teach golfers the proper speed for which a correctly struck putt is hit, alignment and visual focus while practicing the most important aspect of the game of golf, putting.

BACKGROUND—DESCRIPTION OF PRIOR ART

Golf is a difficult and challenging game for which many inventors have created training aids to help golfers develop different aspects of the game. To be proficient at the game and its many different shots and techniques, training aids have been developed to teach proper form, alignment and method of striking a golf ball.

Putting is the most important and difficult part of the game, accounting for half the strokes (36) in a par round (72), with two putts per hole and eighteen holes per round.

Putting is a great test of skill and requires regular, high quality practice sessions with a device that visually represents an actual hole as realistically as possible and has the same "action" as a real hole with the golf ball being able to roll around the rim of the target and either stay in the target or rim around and out of the target. Golfers typically practice putting where ever they can find a suitable surface either outdoors or indoors. In many cases, a carpeted surface indoors must suffice for practicing putting for reasons of inclement weather, time constraints or convenience. In these and similar cases, the golfer has a need for a three dimensional representation of the hole in the form of a putting target that provides direct feedback on both the line and speed for which a properly struck putt is hit.

For many years it has been widely known that a properly struck putt should roll approximately seventeen inches past the hole if the hole was not there. This definition is based on the research of Dave Pelz, a professional golf teacher and Ex-NASA Physicist who authored the book entitled "Putt Like The Pro's", published by HarperPerenial in 1991. This distance is approximate, depending on specific grass types and environmental conditions. It may vary either shorter or longer; however the seventeen inch dimension is the best distance for overall conditions.

An actual hole on a putting green is bored into the ground by a special tool with a depth indicator to a measured distance. A white plastic cup is then inserted into the hole approximately ¼ inch below the surface of the green. This leaves a ring of rich black top soil directly below the surface of the green and directly above the white plastic insert. When visualizing a hole on a putting green, one sees the front half of the hole as being green and the back half of the hole as being a black ¼ inch band approximately 180 degrees around and beneath the surface. As a rule, many people aim at this black line at the back of the hole as a reference target while putting.

Heretofore, many inventors have created conventional practice putting targets or training devices which attempt to simulate a hole but lack the ability to visually represent an actual hole on a putting green in three dimensions and also lack the utility to distinguish between a correctly or incorrectly struck putt. Some devices reduce the diameter of the hole in an attempt to refine the accuracy of the line for which a putt must be hit, while others are mechanically or electrically complicated, visually unrealistic and expensive to manufacture.

The emphasis on the need to visually represent a hole as it actually looks is extremely important. This point was exemplified by the granting of Peabody et al. U.S. Pat. No. 4,936,583, which is a plastic coated photograph depicting an actual hole from eye level taken ten feet away. This patent clearly shows a black ring at the back of the hole and a green front surface. The object of this design was to putt the golf ball over the photograph hole but there is no mechanism of indicating if the golf ball was struck with the correct force or with insufficient or excess force.

Kehoe U.S. Pat. No. 5,435,560 took this depiction of a hole to the next level with a thin, flexible, six inch in diameter disk with a four inch representation of a hole. He then has an adhesive back material line that is placed behind the target seventeen inches and perpendicular to the putting line. The object being to teach the golfer to strike a golf ball with the correct force by having the putt roll through the center of the target and have it come to rest on the line. This target is an unrealistic representation and does not depict what a real hole looks like in three dimensions. It lacks the main gratification of golf, to putt a golf ball into a hole and has no "actions" characteristics like rimming around as with a real hole.

Another example of a conventional putting target is Mueller et al U.S. Pat. No. 5,257,808. This design defines a large number of putting targets available on the market consisting of a putting ring with a sloped outer diameter to "allow ease of entry into the target". The inner diameter is perpendicular to the putting surface and is designed to "retain on line putts even if they are struck with excess force". This design does not have the utility to distinguish between a putt struck with excess force and a putt struck with insufficient force. These targets are also visually unrealistic and do not depict a three dimensional hole as on an actual putting green.

Dimanno et al U.S. Pat. No. 5,275,404 takes this conventional design one step further by making his target symmetrical with two sloped surfaces connecting the inner diameter to the outer diameter of the target. This target is created to be tossable, but still is designed to allow ease of entry of a golf ball into the target and retention of the golf ball even if the putt is struck with excess force and has no means for distinguishing a correctly struck putt from an incorrectly struck putt. He also has no means of visually representing the target in three dimensions by correctly depicting a real hole.

Moreover, the prior art taken as a whole, vast as it is, neither teaches nor suggests a device that captures a golf ball within the target when stroked with the correct tempo and ensuing force, while preventing putts stroked with to slow a tempo and insufficient ensuing force from entering the target and allowing putts stroked with to fast a tempo and excessive ensuing force to roll through the target. Also, none of the targets found in the prior art provide a visually realistic three dimensional representation of a real hole on a putting green. These and other functional utilities will be apparent upon studying the description of the invention.

SUMMARY OF THE INVENTION

It is thus an object of this invention to provide a process for practicing the most important aspect of the game of golf, putting.

It is a further object of this invention to provide a simple and inexpensive putting training system which teaches proper putting technique and helps refine ones putting skills.

It is yet a further object of this invention to provide the golfer with a putting training aid to teach proper force for which a correctly stroked putt is struck, allowing distinction between correctly stroked putts, putts stroked with insufficient force and putts stroked with excess force.

It is yet a further object of this invention to provide a training aid to help develop proper putting stroke tempo for which a correctly stroked putt is struck by providing direct feedback to indicate too slow a tempo, too fast a tempo or the proper tempo of a correct putting stroke;

It is yet a further object of this invention to provide the golfer with a visual, 360 degree around, three dimensional representation of an actual hole on a putting green.

It is yet a further object of this invention to provide a "Dot Focus System" to teach golfers proper eye focus while putting and after the putt has been struck.

It is yet a further object of this invention to provide a symmetrical putting target to be tossed to save both time and energy while practicing putting and to help build eye-hand coordination and judgment of distance with each varying toss of the target.

It is yet a further object of this invention to provide a putting training target which can be easily and effortlessly picked up without bending over.

It is also a further object of this invention to provide a putting training target for a game similar to miniature golf which is played indoors in hallways or large areas of carpeted surfaces with each toss of the target being a new hole, eighteen tosses being a full round and each stroke being added up with the lowest score being the winner.

It is yet a further object of this invention to provide a putting training target which is easily stored in places such as ones back pocket, golf bag and desk drawer to be easily retrieved for practicing in the office, at home, on vacation or on the golf course practice green when it is too crowded with golfers or on the first tee is time constraints dictate.

These and other objects are accomplished by a Copyrighted Tips and Drills direction guide, a Dot Focus System and a 360 degree, three dimensional, symmetrical depiction of an actual hole in the form of a training aid target comprising of a solid circular rubber ring for use in practicing the game of golf, an outer diameter, an inner diameter and a circular cross section, wherein the body of the device is symmetrical about its horizontal axis. The outer half of the circular ring being green and the inner half of the circular ring being black to provide an accurate three dimensional view, 360 degrees around of an actual hole on a putting green. The device, by its design, has the ability to distinguish between a putt stroked with the correct tempo and ensuing force, a putt stroked with too slow a tempo and ensuing force and a putt stroked with too fast a tempo and ensuing force and provides direct feedback to the golfer on his or her accuracy with respect to their putting stroke tempo. The Dot Focus System, which consists of a green adhesive backed dot, is placed on the putting surface and a golf ball is then placed upon this dot. As the golfer is aiming at this accurate depiction of a hole and aligns his body and stroke accordingly, he then focuses on the golf ball and nothing more. The beginning of the putting stroke is a smooth drawing back of the putter with a slow metered tempo, 1—. The next step in the putting stroke is a smooth forward motion of the head of the putter on the putting line with a consistent tempo and good follow through, 2—. Throughout the entire putting stroke, one concentrates entirely on the golf ball and spot where the golf ball once was. This ensures that the golfers head has remained down and that square, smooth contact with the golf ball has been made with the correct tempo and putting line. After all golf balls have been putted, instead of retrieving ones golf balls, one simply rests the head of the putter on the target and draws back the club. Thus the target, with its circular cross section, automatically rolls over and is caught on the head of the putter, eliminating the need to bend over to pick up the target since back pain is a common complaint of most golfers and seniors. One then simply grabs the target from the head of the putter and tosses it to a new location of varying distance. This varying distance improves eye-hand coordination and distance judgment which is a major aspect of putting in itself.

REFERENCE NUMERALS IN DRAWINGS

1 Putting training aid target
2 Outer surface
3 Inner surface
4 Golf ball
5 Putter
6 Putting surface
7 Putting line
8 Dot marker
9 Circular cross section
10 Front edge
11 Back edge

DETAILED DESCRIPTION

Figure 1:
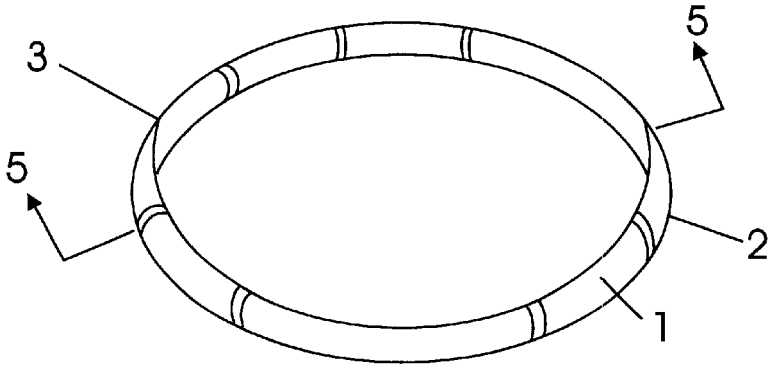
FIG. 1 of the drawings is a perspective view of this invention illustrating the view of the hole as it is seen on a real putting green with visually correct markings distinguishing between the outer and inner surfaces of the hole.

In accordance with this invention, it has been found that in the game of golf, half the strokes taken are on the putting green. Putting is by far the most difficult and rewarding part of the game to master and takes continuous practice to be proficient at this aspect of the game. With this, there has been a need for a simple and inexpensive putting training system to teach golfers proper putting stroke tempo, alignment and visual focus while providing a realistic, three dimensional depiction of a real hole in the form of a putting training aid target which reacts like a real hole and provides direct feedback on the proper putting tempo and ensuing force for which a correctly stroked putt is struck.

The training aid of this system consists of the following components:

1.) A black, rubber, symmetrical putting training aid target 1 the diameter of a typical hole with approximately a ¼ inch circular cross section 9 which utilizes a color pattern to represent a hole in three dimensions. This is done by coating the outer surface 2 of the training aid target green and leaving the inner surface 3 of the training aid target 1 black which depicts the view of a real hole on a putting green. When viewing a hole or the training aid target 1 of this invention, one sees the front edge 10 of the training aid target 1 as being green and the back edge 11 of the training aid target 1 as a black band. This view is extremely important because a target must look as accurate to the real object as possible and a common rule in golf is to aim at this inner black surface 3 at the back of the hole. The training aid target 1 is designed to capture a golf ball 4 stroked with the correct tempo and force within the training aid target 1, prevent a golf ball 4 stroked with too slow a tempo and insufficient force from entering and allow a golf ball 4 stroked with too fast a tempo and excess force to roll through the training aid target 1, teaching golfers the correct putting tempo to stroke a putt with.

2.) The Dot Focus System which consists of a ½ inch green dot 8 with an adhesive backing is placed on the putting surface 6. A golf ball 4 is then placed on the dot 8 and the putt is attempted with the eyes focusing only on the golf ball 4 and the dot 8 after the putter 5 has made contact with the golf ball 4 and it is rolling towards the training aid target 1. This is an extremely important aspect of putting which should be ingrained into the mind. Without this focus, one looks up as the putter 5 makes contact with the golf ball 4 and the line 7 of the putt has changed because the golf ball 4 is in contact with the putter 5 for a relatively long period of time during the putting stroke. The follow through must be exaggerated to ensure the proper line 7 for which a golf ball 4 must roll to go into the hole is adhered to.

3.) The Copy Righted Tips and Drills are the most important aspect of the training system, teaching proper putting stroke alignment, aim, concentration, grip, and putting stroke for both long and short putts for which different drills are described.

These as well as other advantages and features will become apparent from the following descriptions given with references to the various figures and drawings.

Figure 2:
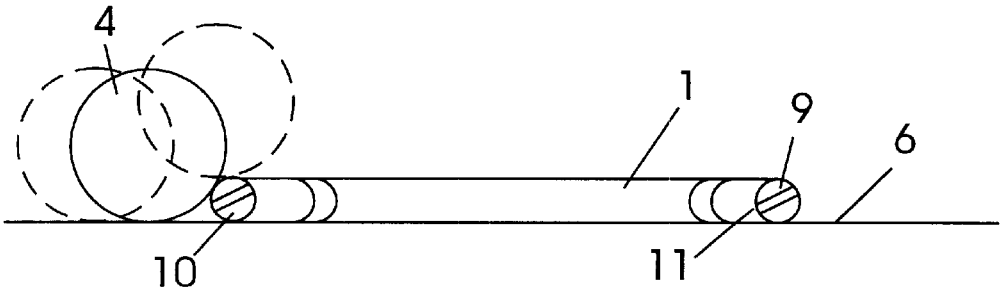
FIG. 2 of the drawings is a cross section of the invention along line 5—5 and a golf ball illustrating an unsuccessful putt which has been stroked with too slow of a tempo, with the ensuing force being to small to overcome the front edge of the target.
Figure 3:
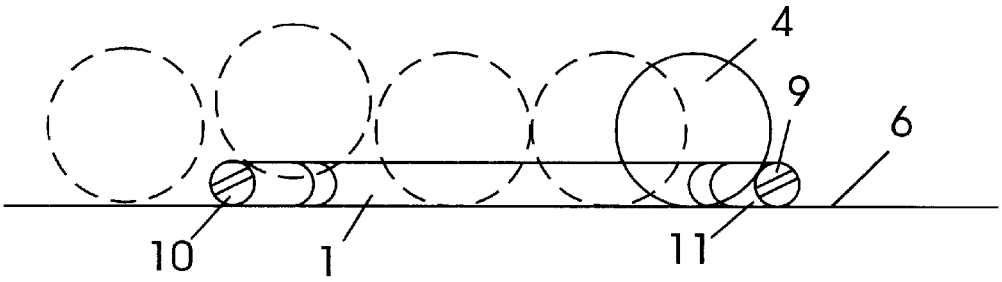
FIG. 3 of the drawings is a cross section of the invention along line 5—5 and a golf ball illustrating a successful putt which has been stroked with the correct tempo and ensuing force to overcome the front edge of the target but lacks enough energy to overcome the back half of the target, exemplifying a correctly stroked golf ball which would roll approximately seventeen inches past the hole on a real putting surface.
Figure 4:
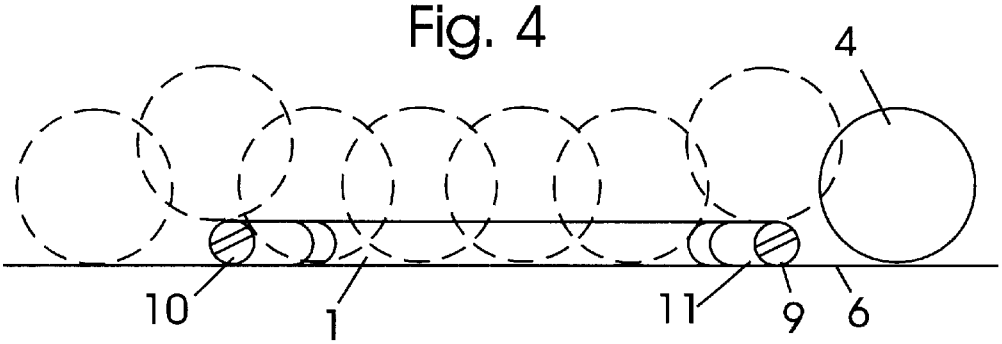
FIG. 4 of the drawings is a cross section of the invention along line 5—5 and a golf ball illustrating an unsuccessful putt which has been stroked with too fast a tempo, with the ensuing force of the putt being to great. This is demonstrated by the putt rolling through the target and continuing on its path.

One preferred embodiment of the training aid target 1, illustrated in FIG. 1 of the drawings is generally a black rubber ring approximately the same diameter as a hole on a putting green with a ½ inch circular cross section 9. The outer surface 2 is distinguished from the inner surface 3 by means of coloring the outer surface 2 green and leaving the inner surface 3 black. This represents three dimensionally the view observed by a golfer when looking at a real hole on a putting green from a distance. The rounded cross section 9 allows a golf ball 4 to react similarly to a real hole on a putting green. This allows a golf ball 4, if not struck directly on the putting line 7 to roll around or rim around the training aid target 1 like a real hole, either staying in the training aid target 1 or rolling out with the similar action as a basketball hoop and basketball. The cross section 9 also stops a golf ball 4 when stroked with too slow a tempo and insufficient force from entering the training aid target 1 as shown in FIG. 2. If the golf ball 4 is stroked with the correct tempo and force, it overcomes the front edge 10 and is captured within the training aid target 1 as shown in FIG. 3. If a golf ball 4 is stroked with too fast a tempo, the ensuing excessive force will overcome both the front edge 10 and back edge 11 of the training aid target 1 and continue on its path as shown in FIG. 4.

Figure 5:
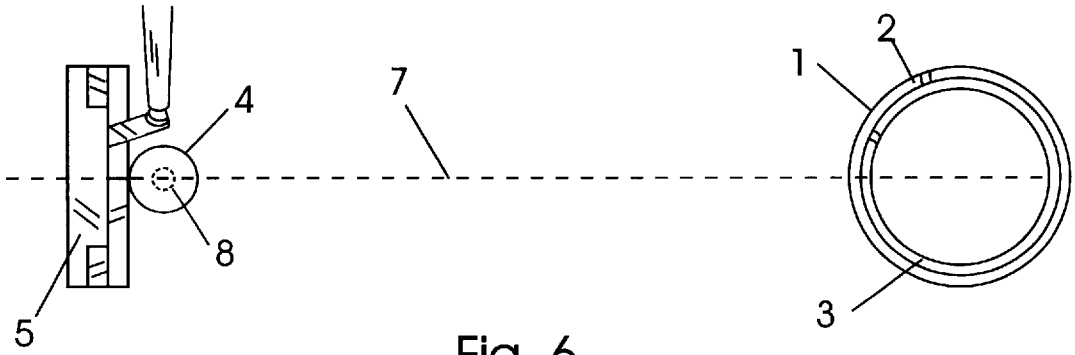
FIG. 5 of the drawings is a top plan view of the invention utilizing the Dot Focus System before a putt has been attempted.
Figure 6:
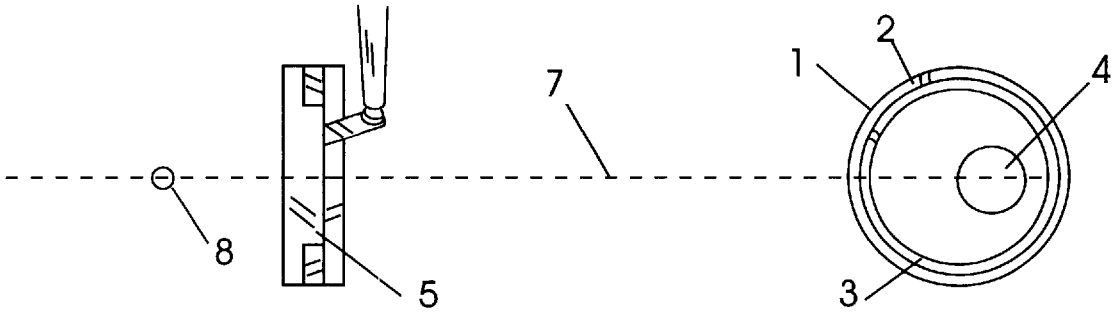
FIG. 6 of the drawings is a top plan view of the invention utilizing the Dot Focus System after the putt has been struck, illustrating where the point of focus is after the golf ball has been struck and is in the hole.

FIG. 5 and FIG. 6 illustrate the Dot Focus System in operation. The dot 8 is placed on the putting surface 6 and a golf ball 4 is placed upon dot 8. A golfer then takes aim at the inner black surface 3 at the back inner edge 11 of the training aid target 1 and with a putter 5 addresses the golf ball 4 according to the putting line 7 as illustrated by FIG. 5. The putt is then attempted with the golfers eyes focused on the golf ball 4 and after the putter 5 has made contact with the golf ball 4, the focus is still on the dot 8 where the golf ball 4 once was as illustrated by FIG. 6.

Figure 7:
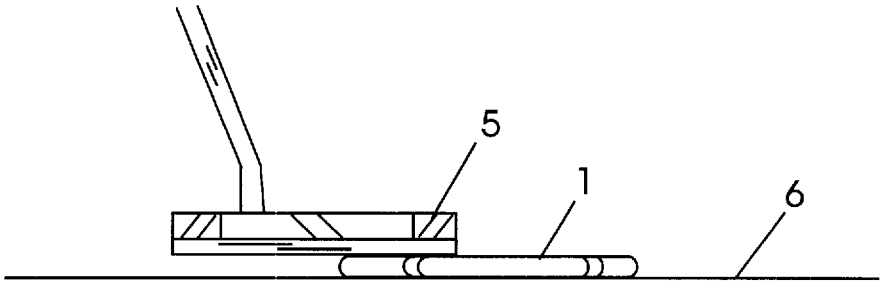
FIG. 7 of the drawings is a side view of a putter and a typical embodiment of the invention indicating proper placement of the putter head in anticipation of hooking the target on the putter.
Figure 8:
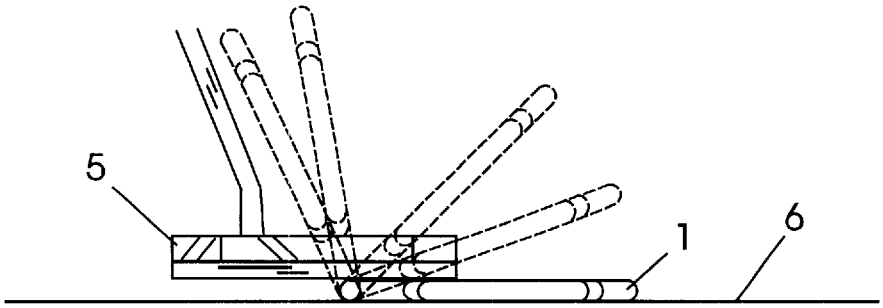
FIG. 8 of the drawings is a side view of a putter and a typical embodiment of the invention after the putter has been drawn back and the target has revolved over the head of the putter hooking itself on to the club and eliminates the need to continuously bend over to pick up the target.

FIG. 7 and FIG. 8 represent how the training aid target 1 is hooked to the putter 5 so the golfer does not have to continuously bend over to pick up the training aid target 1 when tossing it to a new location. The putter 5 is rested on the training aid target 1 as illustrated in FIG. 7. The putter 5 is then drawn back and the training aid target 1 revolves around the putter 5 and is hooked on the club as illustrated in FIG. 8. This is extremely important for seniors and most golfers who usually have back problems due to the unnatural twisting of the body while golfing.

Although the descriptions above contain many specifications, these should not be construed as limiting the scope of the invention but as merely providing illustrations of some of the presently preferred embodiments of the invention. For example, the cross section could take on a slightly different shape, optimizing the focus point for different conditions for which a correctly struck putt is retained or through design, made to be more or less difficult in the length of the dispersion pattern of the golf balls for which the target will except or by increasing the diameter, catering to either children, beginners or experts with the degree of difficulty increasing respectfully. Materials could be changed and the training aid target could also be used with different clubs around the green to help improve accuracy. As many variations will become apparent to those with skill in the art from a reading of the above description which is exemplary in nature, such variations should be considered embodiments within the spirit and scope of this invention.

What is claimed is:

1. A method comprising the steps of locating a toroid on a putting surface, the toroid comprised of inner and outer surfaces, the toroid also comprised of a first edge on the outer surface;

putting a golf ball so that it rolls and contacts the first edge and the outer surface, next rolls over the first edge, next rolls over the inner surface, and next rolls into the toroid; and wherein the inner and outer surfaces have substantially the same shape; and further comprising the steps of:

resting a putter head of a putter on the toroid, and drawing the putter head back while the putter head is resting on the toroid, causing the toroid to revolve around the putter head and to become hooked on the putter.

* * * * *